US006690113B1

(12) United States Patent
Ng

(10) Patent No.: US 6,690,113 B1
(45) Date of Patent: Feb. 10, 2004

(54) FLUORESCENT LIGHTING ASSEMBLY

(75) Inventor: Sherman Ng, South Darthmouth, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/141,744

(22) Filed: May 9, 2002

(51) Int. Cl.[7] ..... H05B 37/00

(52) U.S. Cl. ..... 315/56; 315/58; 362/260; 362/364

(58) Field of Search ..... 315/56, 58; 362/260, 362/364

(56) References Cited

U.S. PATENT DOCUMENTS

| | | | |
|---|---|---|---|
| 2,319,461 | A | 5/1943 | Kelchner |
| 3,247,368 | A | 4/1966 | McHugh |
| 3,705,302 | A | 12/1972 | Judge et al. |
| 3,949,211 | A | 4/1976 | Elms |
| 4,054,790 | A | 10/1977 | Slaughter |
| 4,682,276 | A | 7/1987 | Miller |
| 4,931,914 | A | 6/1990 | Quiogue |
| 5,073,845 | A | 12/1991 | Aubrey |
| 5,381,322 | A | 1/1995 | Humphreys |
| 5,398,179 | A | 3/1995 | Pacheco |
| 5,463,540 | A | 10/1995 | Jones |
| 5,528,473 | A | 6/1996 | Kassay et al. |
| 5,548,497 | A | 8/1996 | Cho |
| 5,580,158 | A | 12/1996 | Aubrey et al. |
| 5,584,575 | A | 12/1996 | Fickel |
| 5,588,737 | A | 12/1996 | Kusmer |
| 5,662,414 | A | 9/1997 | Jennings et al. |
| 5,716,125 | A | 2/1998 | Aubrey |
| 5,720,546 | A | 2/1998 | Correll, Jr. et al. |
| 5,720,548 | A | 2/1998 | Geary |
| 5,820,252 | A | 10/1998 | Finch |
| 5,828,174 | A | 10/1998 | Seiler et al. |
| 5,908,235 | A | 6/1999 | Petrozello et al. |

*Primary Examiner*—David Vu
(74) *Attorney, Agent, or Firm*—Charles G. Lamb; Middleton Reutlinger

(57) ABSTRACT

A retrofit kit, including a fluorescent lighting assembly for replacing an incandescent light assembly, includes a housing having a ballast receiving section and a fluorescent lamp receiving section. A ballast is disposed within the ballast receiving section and a socket assembly, generally adjustable, is disposed within the lamp receiving section and is in electrical communication with the ballast. The socket assembly includes a socket cup with an opening to receive a fluorescent lamp in a vertical orientation.

9 Claims, 4 Drawing Sheets

FLUORESCENT LIGHTING ASSEMBLY

BACKGROUND OF THE INVENTION

The present invention relates to an improved fluorescent lighting assembly and more particularly to a method for retrofitting an incandescent lighting assembly with a fluorescent lighting assembly.

It is relatively common place to install luminaires in or above the ceilings of rooms to direct light into the room. Many of these include sockets to receive incandescent lamps. With the improvements in fluorescent lamp design, as well as the energy efficiency obtained through the use of fluorescent lamps, there is a desire to replace these existing incandescent luminaires with fluorescent luminaires. However, the retrofitting of fluorescent light assemblies for incandescent light assemblies requires the use of a ballast in combination with the fluorescent light assembly in making the retrofit. In this retrofitting the incandescent socket assembly is removed and a ballast is added which is generally mounted onto a J-box cover to which the electrical connections for the fluorescent lighting assembly is then connected. Also, in many cases, the openings in the ceilings must be re-cut. Thus, there is a need for a retrofitting assembly, which is relatively inexpensive and easy to install.

SUMMARY OF THE INVENTION

It is an object of the present invention to provide a retrofit fluorescent lighting assembly for replacing an incandescent lighting assembly.

It is another object of the present invention to provide a fluorescent lighting assembly having a ballast therein and a fluorescent socket assembly in electrical communication therewith.

It is a further object of the present invention to provide an adjustable socket assembly for fluorescent lighting assembly for use with different sizes of fluorescent lights in a vertical and horizontal orientation.

It is also an object of the present invention to a retrofit fluorescent lamp assembly incorporating a socket cup assembly for a fluorescent lamp in a vertical and horizontal orientation, a ballast and reflector latches to fit various diameter reflector trims into a mounting frame.

More particularly, the present invention provides a retrofit fluorescent lighting assembly, which includes a housing having a ballast receiving section and a lamp receiving section. A ballast is disposed within the ballast receiving section and an adjustable socket assembly is disposed within the lamp receiving section. The adjustable socket assembly is in electrical communication with the ballast and also includes the socket cup with an opening to receive a fluorescent lamp in a vertical and horizontal orientation.

Even more particularly, the present invention provides a method of retrofitting an incandescent lighting assembly with a fluorescent lighting assembly which includes the steps of: removing an incandescent lighting assembly from an opening in a ceiling and then inserting a fluorescent lighting assembly into the opening wherein the fluorescent lighting assembly includes a housing having a ballast receiving section and a lamp receiving section with a ballast in electrical communication with a socket assembly disposed in the lamp receiving section.

Additional objects, features and advantages of the present invention will become apparent to those skilled in the art, upon consideration of the following detailed description of the preferred embodiments as presently perceived.

DETAILED DESCRIPTION OF THE PREFERRED EMBODIMENTS

Figure 1:
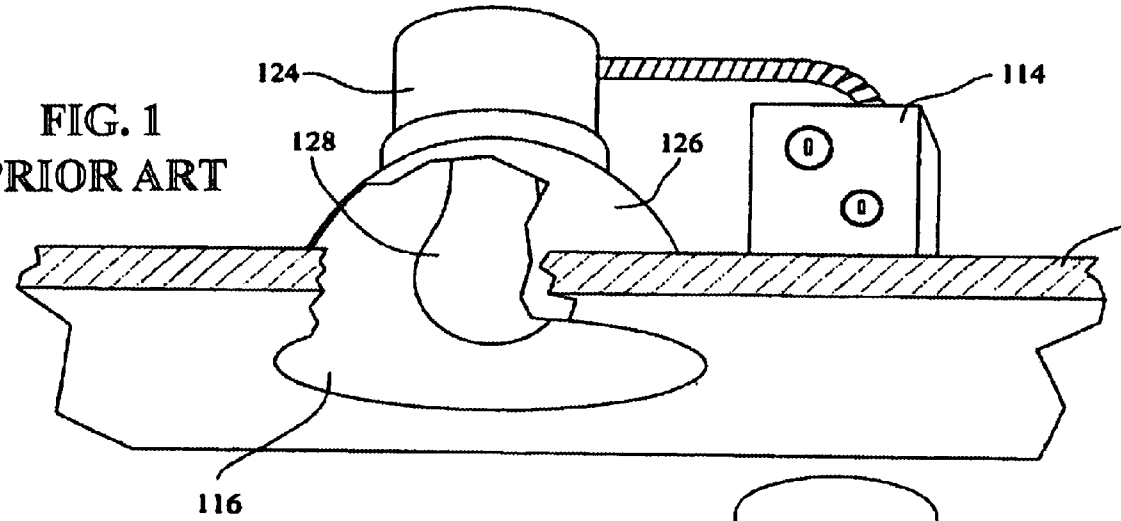
FIG. 1 PRIOR ART
FIG. 1 is a perspective view, with selected portions cut-away, of a prior art incandescent lighting assembly.

In FIG. 1 is shown a prior art ceiling mounted incandescent lighting assembly. As shown, a ceiling 102 is provided with a cutout or opening 116 to receive an incandescent socket assembly 124 and a reflector 126. Reflector 126 generally includes an opening of substantially the same surface area as the opening 116. And, socket assembly 124 is in electrical communication with an electric outlet 114. Additionally, incandescent lamp 128 is received by the socket assembly 124.

Figure 2:
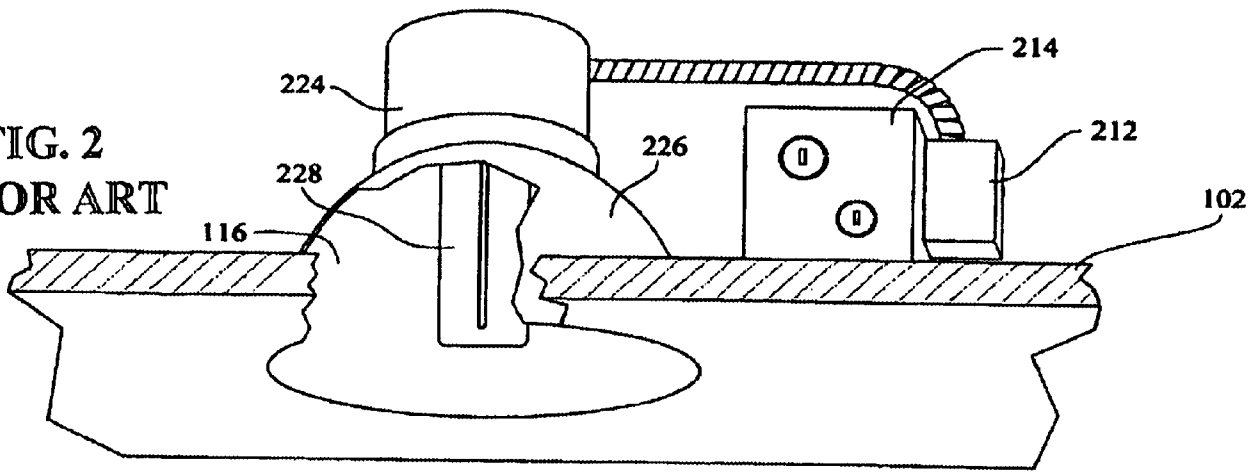
FIG. 2 PRIOR ART
FIG. 2 is a perspective view, with selected portions cut-away, of a prior art vertical orientation fluorescent lighting assembly.

In view of the energy saving of fluorescent lamps, it is common place to replace the incandescent lamp assemblies with fluorescent lamp assemblies, such as the one shown in FIG. 2. In FIG. 2, the ceiling 102, including the cut opening 116 therein, includes a fluorescent socket assembly 224 with a reflector 226 which replaces the incandescent socket assembly 124 and its reflector 126. Additionally, ballast 212 is installed, which is in electrical communication with the socket assembly 224 and the electrical outlet 214. Also, the fluorescent socket assembly 224 is in receipt of a compact fluorescent tubular lamp 228.

Figure 5:
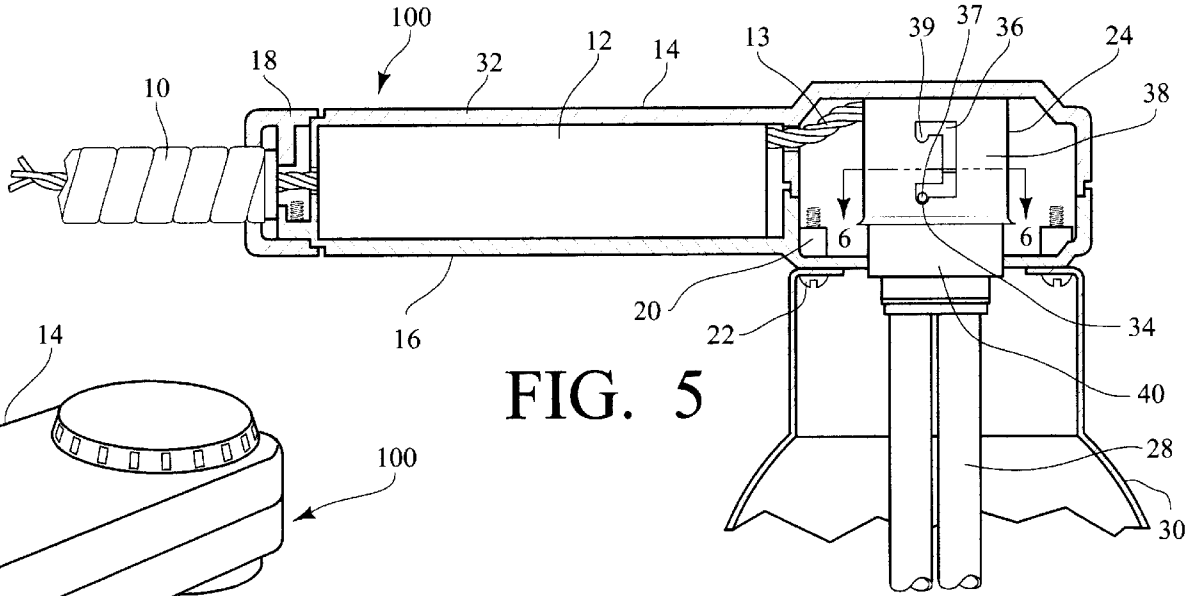
FIG. 5 is a sectional view taken along lines 5—5 of FIG. 4.
Figure 4:
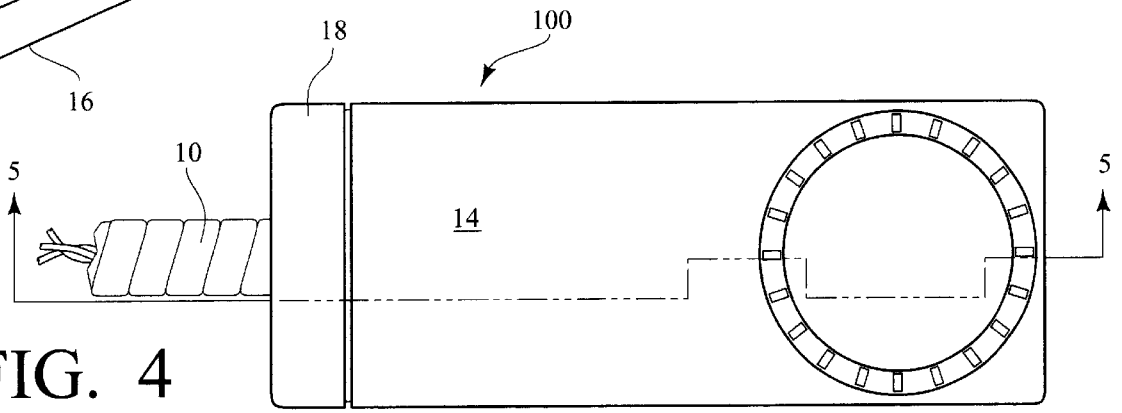
FIG. 4 is a top view of FIG. 3.
Figure 3:
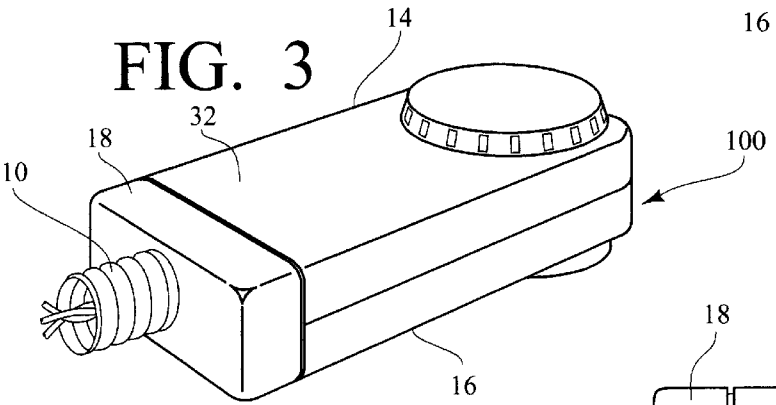
FIG. 3 is a perspective view of a retrofit fluorescent lighting assembly of the present invention.
Figure 6:
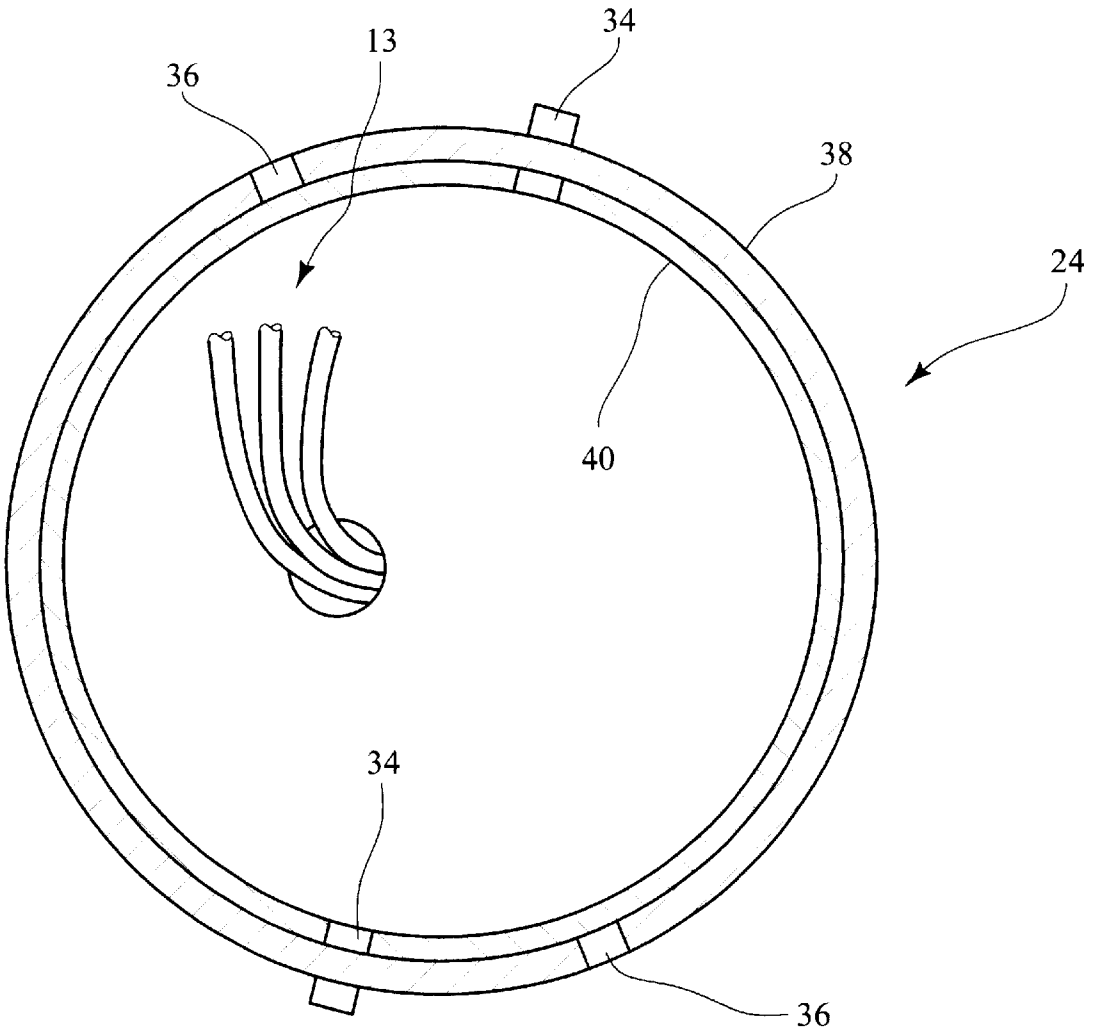
FIG. 6 is a sectional view taken along lines 6—6 of FIG. 5.

In FIGS. 3–6 is shown a retrofit fluorescent lighting assembly of the present invention replacing an incandescent lighting fixture, such as the one shown in FIG. 1. The retrofit fluorescent lighting assembly is indicated by the numeral 100 and includes a housing 32 having a top 14 and a bottom 16 with an end cap 18 which snaps onto the top 14 and the bottom 16. The end cap 18 is provided with an opening therein to receive electrical cable 10. Electrical cable 10 is in electrical communication with ballast 12 and the ballast 12, in turn, is in electrical communication through electrical leads 13 with socket assembly 24. The socket assembly 24 includes an upper socket cup 38 of cylindrical configuration having opposed C-shaped slots 36 therein. The socket assembly 24 also includes a lower socket cup 40, which receives fluorescent lamp 28 therein. The lower socket cup 40 is provided with a pair of outwardly extending pins 34 on opposed sides of the socket for receipt within the C-shaped slot 36 thereby allowing adjustability of the lower socket cup 40 from a lowered position, as shown in FIG. 5, to an upper position which is defined by the groove 39 in the upper terminating arm of the C-shaped slot 36. The retrofit lighting assembly 100 is also used with a reflector or reflector trim 30 to secure to the bottom 16 of the housing 32 with a threaded bolt 22 which is received by a threaded through bore 20. A plurality of threaded bolts 22 and threaded through bores 20 are provided usually in a combination of at four distinct locations along the bottom 16 of the housing 32. It is realized, in many instances, the reflector or reflector trim used with the incandescent lamp assembly may be used in the present invention.

Figure 8:
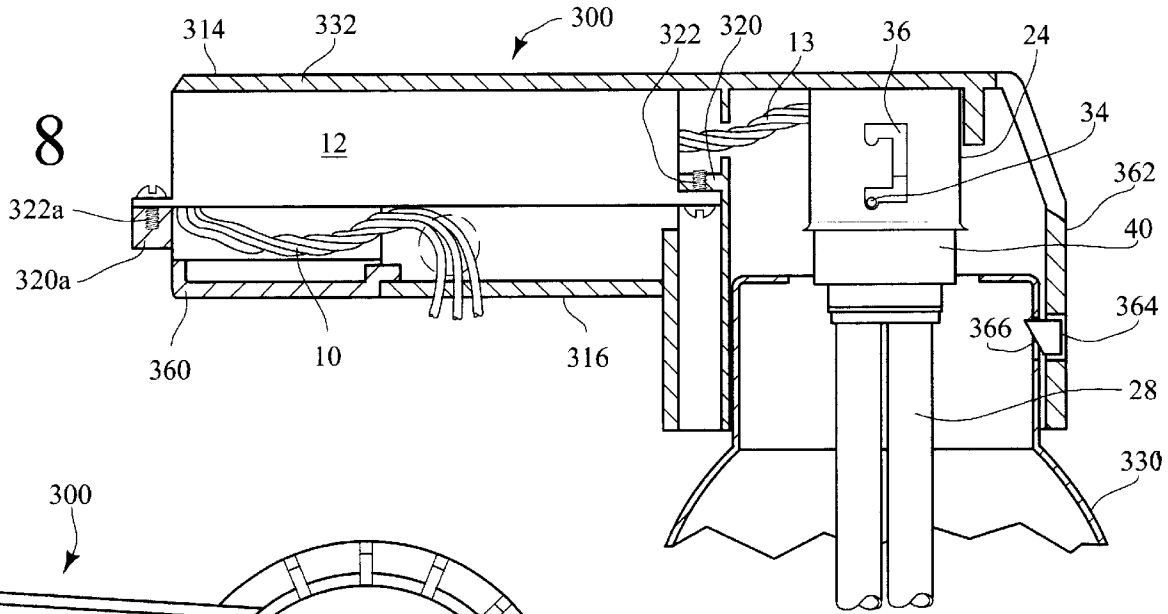
Figure 7:
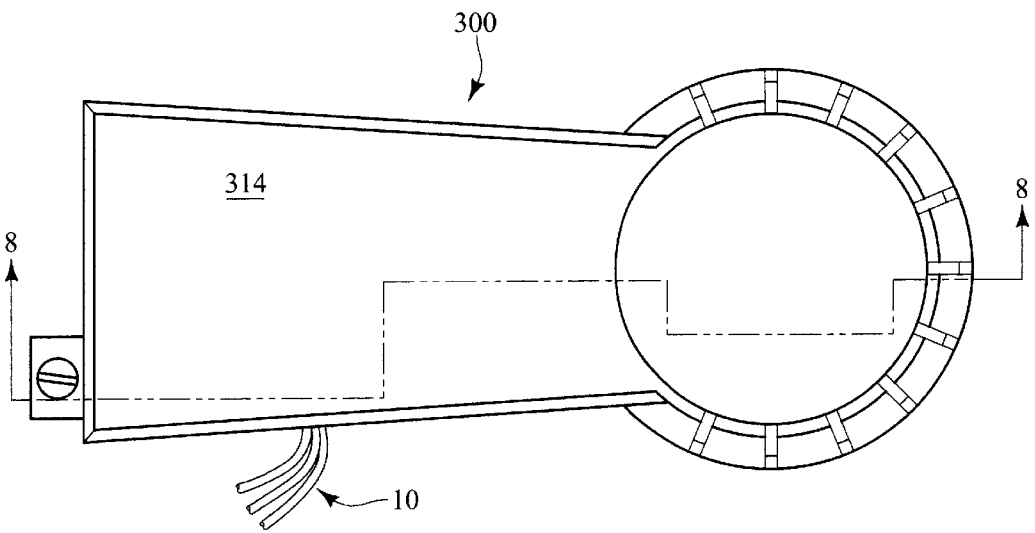
FIG. 7 is a top view of another embodiment of a fluorescent lighting assembly of the present invention; and, FIG. 8 is a sectional view taken along lines 8—8 of FIG. 7.

In FIGS. 7 and 8, as shown, is another retrofitting for a fluorescent lighting assembly of the present invention wherein the fluorescent lighting assembly is identified by the numeral 300 and includes a housing 332 having a top 314 and a bottom 316 with a cable 10 being received within a side of the housing 332 in electrical communication with the ballast 12. A detachable cover plate 360 is disposed along the bottom of the housing and engages with a terminating end of the bottom wall 316. The top of ballast 12 is attached to the bottom of the housing with the use of a threaded bolt 322*a*, received with an aligned threaded through bore 320*a* in the top 314 and the bottom 316, as well as threaded bolt 322, which is received by an aligned threaded through bore 320. The reflector 330 is provided with a pair of slots 366 in an upper portion thereof for receiving snap or twist/lock latches 364 in end 362 of the housing 332. Latch 364 secures the housing 332 with reflector trims of varying diameters.

In the retrofitting of an incandescent lighting assembly with a fluorescent lighting assembly as shown in FIGS. 3–6, the existing incandescent lighting assembly having a reflector trim with an opening of the same cross-sectional area of the retrofit assembly to be installed, is removed from the opening in the ceiling which includes disconnecting the incandescent lighting assembly from the electrical supply source. The reflector trim can be removed from the incandescent lighting assembly and used with the retrofit fluorescent lighting assembly or it may be discarded and replaced with fluorescent reflector trim. In any case, retrofit fluorescent lighting assembly of the present invention is then connected to the electrical supply source and a reflector trim whether it be with the retrofit assembly or be the previously used reflector trim with the incandescent assembly, is then attached to the housing for the fluorescent lighting assembly. A fluorescent lamp of a preselected size is then inserted into the lower socket cup 40 in the socket assembly 24 and depending upon the length of the fluorescent lamp 28, lower socket cup 40 is adjusted so that the pin 34 is either disposed within a groove 37 in the lower portion of the C-shaped slot 36, or the groove 39 in the upper section of the C-shaped slot. In a preferred embodiment the fluorescent lighting assembly receives a 4" fluorescent lamp or a 7" lamp in a vertical orientation.

Although the invention has been described in detail with reference to preferred embodiments, variations in modifications exist within the scope and spirit of the invention as described and defined in the claims appended hereto.

What is claimed is:

1. A fluorescent lighting assembly comprising:

a housing having a ballast receiving section and a lamp receiving section;

a ballast disposed within said ballast receiving section;

an adjustable socket assembly disposed within said lamp receiving section, said adjustable socket assembly being in electrical communication with said ballast, said adjustable socket assembly having a lower socket cup with an opening to receive a fluorescent lamp.

2. The assembly of claim 1, said socket assembly having an upper cup in receipt of said lower socket cup.

3. The assembly of claim 2, said upper cup and said lower socket cup being in adjustable mating relation.

4. The assembly of claim 3, said upper cup having a C-shaped slot, said lower socket cup having an outwardly extending pin received within said C-shaped slot.

5. The assembly of claim 1, including a reflector trim attached to a bottom wall of said housing, said reflector trim circumscribing said lower socket cup.

6. The assembly of claim 1, said lamp receiving section having an end wall with latches therein for engagement with a mating latch receiving slot in an upper portion of a reflector trim.

7. A method of retrofitting an incandescent lighting assembly with a fluorescent lighting assembly comprising the steps of:

a) removing an incandescent lighting assembly from an opening in a ceiling, said removing including disconnecting an incandescent lighting assembly from an electrical supply source;

b) inserting a fluorescent lighting assembly into said opening and connecting said fluorescent lighting assembly to said electrical energy source, said fluorescent lighting assembly comprising a housing having a ballast receiving section and a lamp receiving section; a ballast disposed within said ballast receiving section; and, a socket assembly disposed within said lamp receiving section, said socket assembly being in electrical communication with said ballast, said socket assembly having a socket cup with an opening to receive a fluorescent lamp in a vertical orientation.

8. The method of claim 7 wherein said socket assembly is an adjustable socket assembly.

9. The method of claim 7 including the step of disconnecting reflector trim from said incandescent lighting assembly and attaching said reflector trim to said fluorescent lighting assembly.

* * * * *